US005907969A

United States Patent [19]

Soder

[11] Patent Number: 5,907,969

[45] Date of Patent: Jun. 1, 1999

[54] TOOL FOR WORKING SHAPED, HOLLOW METAL TUBING TO ACHIEVE AN END REDUCTION

[76] Inventor: James T. Soder, 1994 Gallina Cir., Collierville, Tenn. 38017

[21] Appl. No.: 08/957,354

[22] Filed: Oct. 24, 1997

Related U.S. Application Data

[60] Provisional application No. 60/040,835, Mar. 19, 1997.

[51] Int. Cl.[6] ..... B21B 17/02; B21B 17/00

[52] U.S. Cl. ..... 72/370.01; 72/208

[58] Field of Search ..... 72/208, 209, 264, 72/283, 367.1, 369, 370.01, 370.02, 370.1, 370.25, 370.26, 398, 193

[56] References Cited

U.S. PATENT DOCUMENTS

| | | | |
|---|---|---|---|
| 1,019,968 | 3/1912 | Koenig . | |
| 1,890,077 | 12/1932 | Elting . | |
| 2,055,771 | 9/1936 | McLaughlin | 29/156 |
| 2,059,124 | 10/1936 | Layton | 29/33 |
| 2,207,245 | 7/1940 | Dvorak | 80/12 |
| 2,371,697 | 3/1945 | Logan | 80/12 |
| 2,505,241 | 4/1950 | Gray et al. | 153/28 |
| 3,611,775 | 10/1971 | Gabel et al. | 72/209 |
| 3,813,911 | 6/1974 | Bibighaus | 72/208 |
| 3,842,635 | 10/1974 | Bibighaus | 72/208 |
| 4,275,578 | 6/1981 | Steinbrecher et al. | 72/208 |
| 4,487,049 | 12/1984 | Danchenko et al. | 72/208 |
| 4,982,487 | 1/1991 | Maruko et al. | 29/243.58 |
| 5,040,399 | 8/1991 | Knapper et al. | 72/200 |
| 5,533,370 | 7/1996 | Kuroda et al. | 72/370.25 |

*Primary Examiner*—Joseph J. Hail, III
*Assistant Examiner*—Rodney Butler
*Attorney, Agent, or Firm*—Garrison, Morris & Haight

[57] ABSTRACT

A tool is provided for working a shaped metal tube, such as a square or rectangular metal tube, having a hollow interior and an outer surface to produce an end reduction in the tube. The tool includes a head having a longitudinally extending interior cavity and a plurality of roller cavities, each communicating with the interior cavity. A plurality of grooved rollers are rotatably mounted within the head, one within each of the roller cavities. Each of the grooved rollers has a periphery extending into the interior cavity and configured to engage a portion of the outer surface of the tube to be reduced, such as a corner portion of a square tube. Depending upon the shape of the tube being reduced, the tool may further include a pair of flat-area rollers. The flat-area rollers may be used to engage the relatively long sides of a rectangular tube. The tool further includes a mandrel disposed within the interior cavity of the head and spaced apart from the periphery of each of the rollers, with the mandrel being effective for preventing the tube from collapsing as a result of the end reduction. The tool may also include a rake which is effective for maintaining the shape of the end of the tube being reduced.

25 Claims, 11 Drawing Sheets

TOOL FOR WORKING SHAPED, HOLLOW METAL TUBING TO ACHIEVE AN END REDUCTION

CROSS-REFERENCES

The subjection application claims the priority benefits of U.S. Provisional Patent Application having Ser. No. 60/040,835 filed on Mar. 19, 1997, entitled: "Tool for Swaging Metal Tubing, and Integral Tubular Framing System Incorporating Swaged Metal Tubing."

BACKGROUND

1. Field of the Invention

The present invention relates generally to a tool for working shaped, hollow metal tubing and, more particularly, to a tool for working shaped, hollow metal tubing to achieve an end reduction in the tubing.

2. Related Art

In the metal fabrication industry it is often necessary or advantageous to join adjacent lengths of hollow metal tubing to one another, as part of various structures. It is particularly advantageous to utilize either square or rectangular metal tubing in many applications, because of their shape and associated mechanical strength. Known methods of reducing square and rectangular metal tubing have typically utilized one or more dyes. With this form of reduction, one end of the square or rectangular tube is crushed by the force created by various configurations of press equipment, with the size of the reduction being determined by the die design. This method of end reduction of square and rectangular tubing is subject to the following disadvantages. In the first instance, the end reduction of the tubing may require several "hits" or applications of the press equipment to achieve the desired reduction, with each application adding to the manufacturing cost. Furthermore, the crushing force of the press equipment may cause excessive and/or non-uniform deformation of the tube end. More specifically, one or more of the sides of the tubing may become concave, thereby reducing the overall strength of the tube and detracting from the smoothness of the transition between the original shape and the reduced end. In certain instances, the excessive and/or non-uniform deformation may be so severe that the reduced end of the tube is not capable of insertion into a tube of the same size prior to reduction, as intended.

Due to the foregoing problems associated with the use of dies to end reduce square and rectangular tubing, connections of adjacent lengths of like-sized square and rectangular tubing are generally accomplished by inserting a smaller tube inside the two adjacent like-sized pieces of tubing, and then securing the joint by fastening each section of the outside tubing to the inside tube. The inside tube, as well as the required fasteners, add to the cost of this method of joining sections of square or rectangular tubing. Another disadvantage associated with this technique is that the strength of the joint is limited to the strength of the included fasteners.

In view of the foregoing disadvantages associated with known methods of connecting square and rectangular metal tubing, there is a continuing need for improved methods of joining adjacent sections of shaped metal tubing, such as square and rectangular tubing.

SUMMARY

In view of the foregoing needs, the present invention is directed to a tool for working a shaped metal tube having a hollow interior and an outer surface to produce an end reduction in the tube. The tool of the present invention may be configured to achieve an end reduction in metal tubes having various shapes including square, rectangular, oval and D-shaped. In each embodiment, the tool achieves a substantially uniform reduction, over a predetermined longitudinal length, of the end portion of the tube so that the reduced end retains its original shape. Accordingly, the reduced end may be inserted into a non-reduced end of a tube having the same shape and size. The end reduction of the shaped tube is achieved in a single pass of the tube into the tool. Accordingly, the tool provides a simple, fast and economical means for uniformly reducing the end of a tube to permit the tube to be joined to a similarly shaped and like-sized tube having the same outside dimensions prior to reduction.

The tool of the present invention, facilitates the use of metal tubing in a wide variety of metal fabrication applications. For instance, the use of square and rectangular tubing, having reduced ends achieved by the tool of the present invention, may provide a flat surface area for mounting which is advantageous in many applications. Also, since the tool of the present invention may be applied in a production setting capable of relatively high speed production and relatively low cost, the tool of the present invention may warrant the redesign of many existing products to take advantage of the use of metal tubing sections which may be joined to one another in a simple and economic fashion. Furthermore, the tool of the present invention will permit a wide variety of new product ideas and designs.

According to a preferred embodiment of the present invention, the tool includes a head having a longitudinally extending interior cavity and a plurality of roller cavities each communicating with the interior cavity, and a plurality of grooved rollers, each rotatably mounted within one of the roller cavities. Each of the grooved rollers has a periphery which extends into the interior cavity and is configured, i.e., positioned and sized, to engage a portion of the outer surface of the tube as the tube passes into the interior cavity of the head, thereby forcing the end portion of the tube to be reduced. The head further includes a mandrel disposed within the interior cavity of the head, with the mandrel permitting the end reduction of the tube to be accomplished without collapsing the reduced end of the tube. The mandrel preferably comprises a solid rod having a polygonal cross-sectional shape which varies with the shape of the tube to be reduced.

The head includes a base block, a spacer portion connected to the base block and a face block portion connected to the spacer portion. These components of the head may be made as a unitary construction or alternatively may be fixedly attached to one another by conventional fasteners. The base block, spacer portion and face block portion combine to define the interior cavity and the face block portion includes the roller cavities and a plurality of face blocks configured to define the roller cavities.

Each of the grooved rollers is rotatably mounted on a roll pin which is secured within adjacent ones of the face blocks of the head. The periphery of each of the grooved rollers includes a centrally disposed, generally V-shaped portion which is effective for engaging a portion of the tube, such as a corner portion of a square or rectangular tube, as the tube passes into the interior cavity of the head. The periphery of the grooved rollers further includes a pair of beveled end surfaces extending from opposite sides of the centrally disposed V-shaped portion.

In one preferred embodiment, having particular application for reducing the end of a substantially square tube, the tool includes four of the grooved rollers, with two of the rollers being rotatable in a substantially horizontal plane and the remaining two rollers being rotatable in a substantially vertical plane. In this embodiment, each of the end surfaces of each grooved roller is disposed in close proximity to one of the end surfaces of an adjacent one of the rollers, whereby the plurality of grooved rollers substantially encapsulate the square tube as the square tube engages the rollers. In this embodiment, the mandrel has a generally square cross-sectional shape. The mandrel includes at least one longitudinally extending lead- in chamfer to facilitate insertion of the mandrel within the hollow interior of the tube.

In another preferred embodiment, which is particularly suited for reducing the end of a substantially rectangular tube, the tool includes four of the grooved rollers and further includes a pair of flat-area rollers, with each flat-area roller being disposed laterally between a pair of the grooved rollers. Each of the flat-area rollers is effective for engaging one of the relatively long sides of the rectangular tube as the tube passes into the interior cavity of the head. In this embodiment, each of the flat-area rollers is rotatable in a substantially vertical plane, while each of the grooved rollers is rotatable in a plane which is inclined relative to vertical. The four grooved rollers and two flat-area rollers are disposed relative to one another so as to substantially encapsulate the tube as the tube passes into the interior cavity and engages the rollers. In this embodiment, as well as the previously discussed embodiment, each of the rollers is preferably made of tool steel.

Each of the flat-area rollers may include a pair of substantially cylindrical end portions and a raised, substantially cylindrical central portion extending between the end portions, with the raised, central portion extending radially beyond the end portions. The incorporation of the raised, central portion may vary with application of the tool and is particularly useful when the length of the long side of the rectangular tube is substantially longer than the length of the short side of the rectangular tube. The raised portion is effective for engaging the long side of the tube and facilitating the end reduction of the tube. One of the flat-area rollers is disposed above the mandrel, with the other being disposed below the mandrel. In the embodiments having flat- area rollers which include the raised, central portion, the mandrel has a pair of longitudinally extending grooves, with one of the grooves being formed in the upper surface of the mandrel and the other groove being formed in the lower surface of the mandrel. Each of the grooves has a shape which is complimentary to the shape of the raised, central portion of one of the flat-area rollers.

The tool may further include a means for maintaining a substantially uniform shape of the reduced end of the tube, with the means for maintaining comprising a rake disposed within the interior cavity of the head. The rake includes an aperture extending therethrough and communicating with the interior cavity. The aperture includes a forward, flared portion and a tapered bore extending longitudinally rearward from the forward, flared portion. The flared portion serves as a lead-in while the tapered bore forces the reduced end of the tube to maintain the desired shape and size. The rake may be used in conjunction with any of the previously described embodiments. When the rake is included, the mandrel extends longitudinally through the aperture of the rake and into the base block.

BRIEF DESCRIPTION OF THE DRAWINGS

These and other features, aspects and advantages of the present invention will become better understood with regard to the following description, appended claims and accompanying drawings wherein:

DETAILED DESCRIPTION

Figure 5:
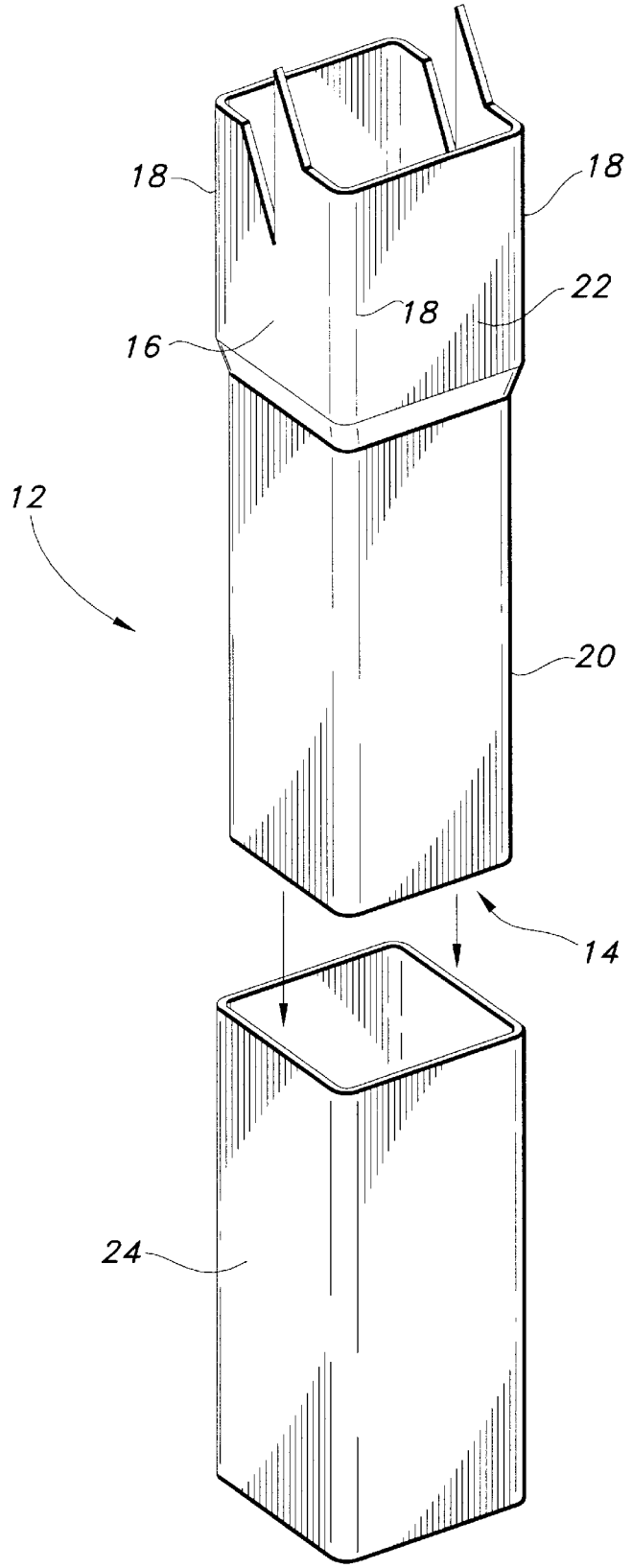
FIG. 5 is a perspective view of a square metal tube having an end reduction achieved by the tool shown in FIGS. 1–4.

Referring now to the drawings, FIGS. 1–4 illustrate a tool 10 according to a first embodiment of the present invention. As shown in FIGS. 1–4, tool 10 is configured to achieve a swage, extrusion or end reduction in a square, hollow metal tube 12 shown in FIG. 5. In other embodiments, tool 10 may be reconfigured to achieve an end reduction in metal tubes having other shapes, such as rectangular, oval or D-shaped tubes as subsequently discussed. The square, hollow tube 12 has a hollow interior 14 and an outer surface 16 having a substantially square shape. The outer surface 16 includes four corner portions 18 which extend along the longitudinal length of tube 12. As shown in FIG. 5, tube 12 includes an end portion 20 which has been reduced in size by tool 10, as subsequently discussed, relative to the original size of a remaining portion 22 of tube 12. As further shown in FIG. 5, the reduced end portion 20 has a substantially uniform square shape which is substantially the same as that of the remaining portion 22. The reduced end portion 20 may be inserted into a non-reduced square tube 24 having the same size as that of the remaining portion 22 of tube 12.

Tool 10 includes a head 30 having a longitudinally extending interior cavity 32 and a plurality of roller cavities 34. Each of the roller cavities 34 communicates with a forward portion of the interior cavity 32. The head 30 includes a base block 36, a spacer portion 38, and a face block portion 40. In the illustrative embodiment the spacer portion 38 includes a pair of spacer blocks 42 which are laterally spaced apart from one another. The face block portion 40 includes four face blocks 44 which are configured to define the roller cavities 34. In the illustrative embodiment, the face block portion 40, spacer portion 38 and base block 36 are fixedly attached to one another by a plurality of conventional fasteners such as bolts 46. Each of the bolts 46 passes longitudinally through one of the face blocks 44, through the adjacent one of the spacer blocks 42 and is then threaded into the base block 36. Alternatively, the face block portion 40, spacer portion 38 and base block 36 may be made as a unitary, or one piece construction, of cold rolled steel, tool steel or other suitable alloys or metals.

Figure 2:
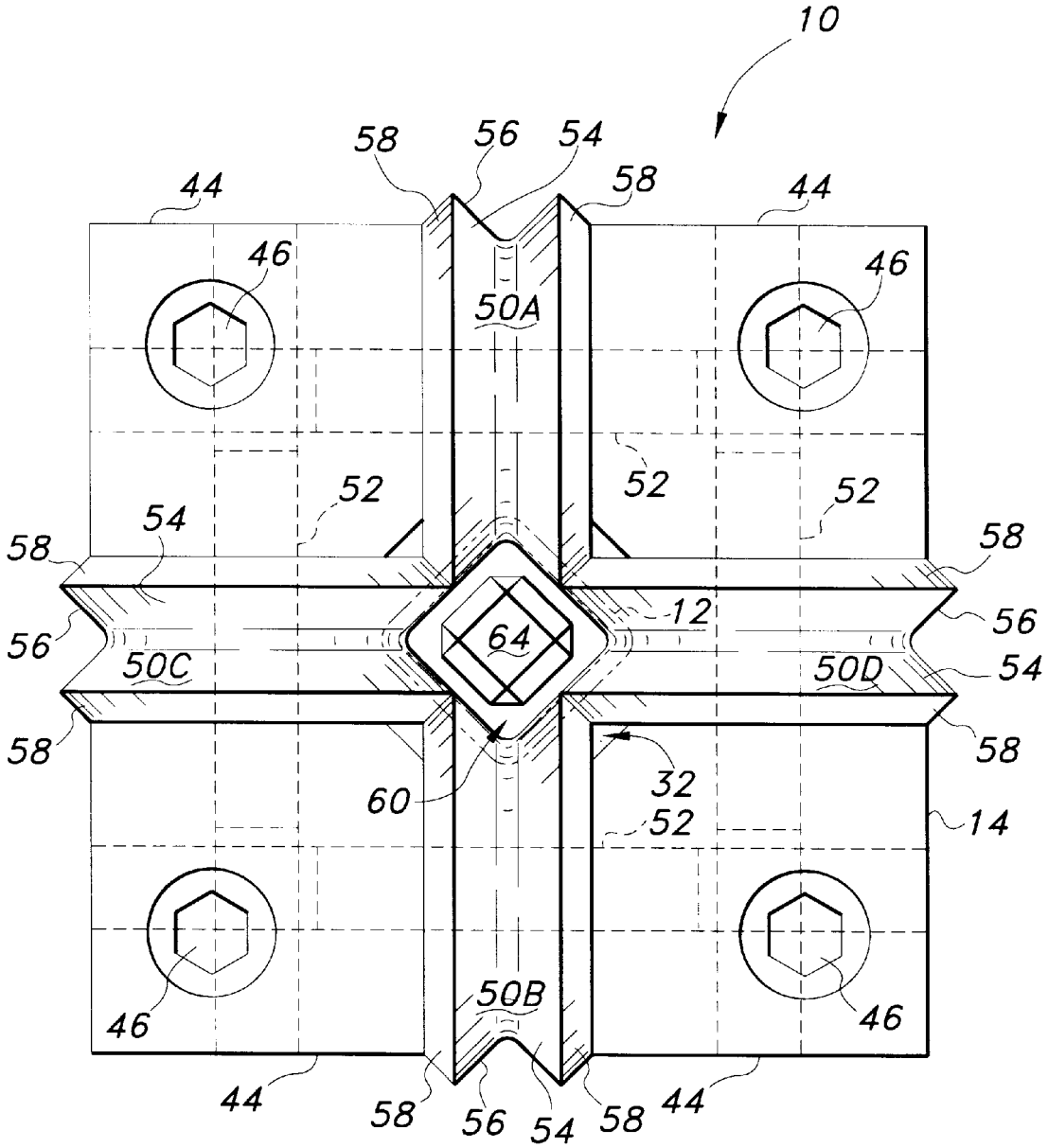
FIG. 2 is a front elevational view further illustrating the tool shown in FIG. 1.
Figure 3:
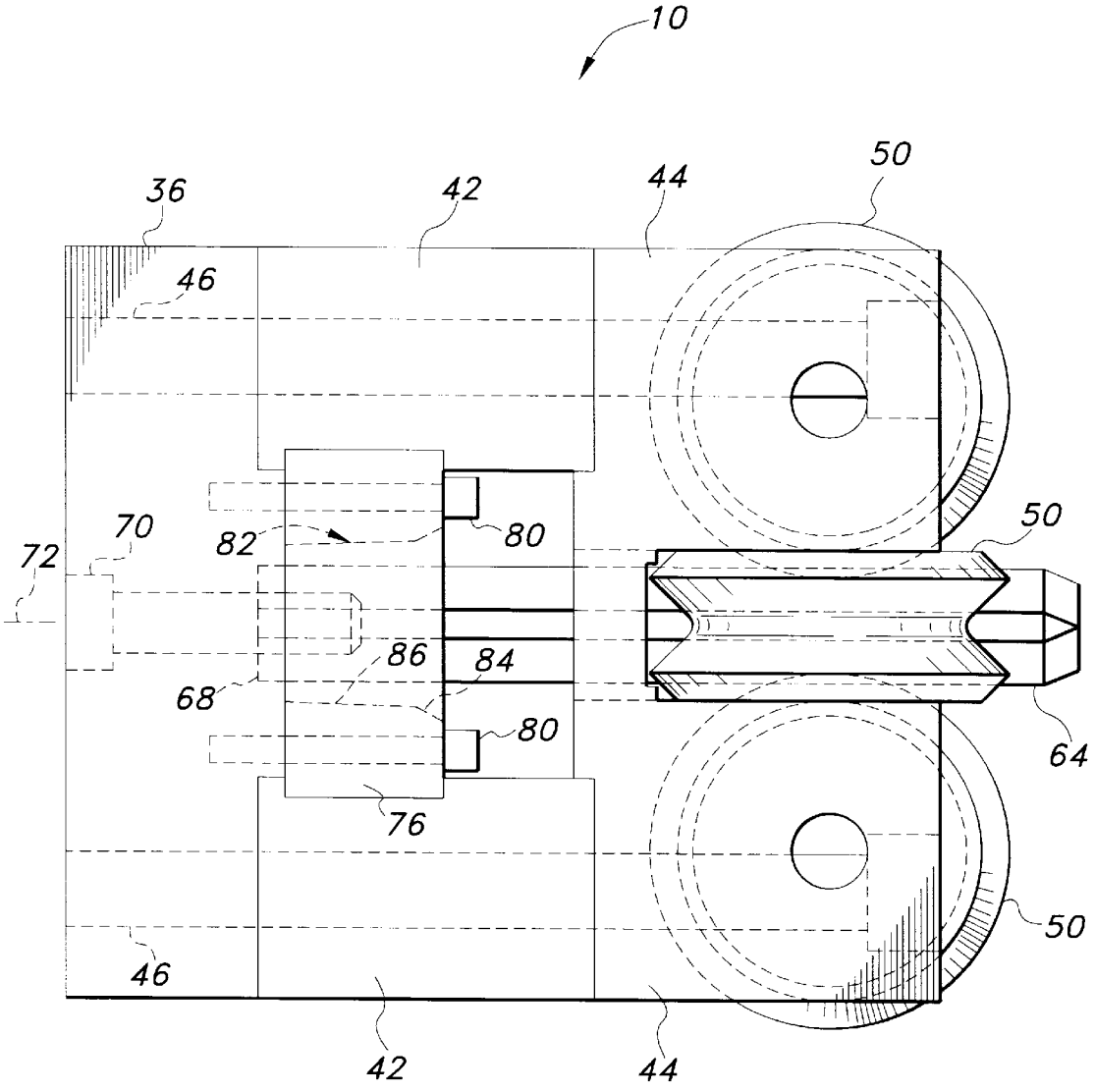
FIG. 3 is a plan view further illustrating the tool shown in FIGS. 1 and 2.
Figure 4:
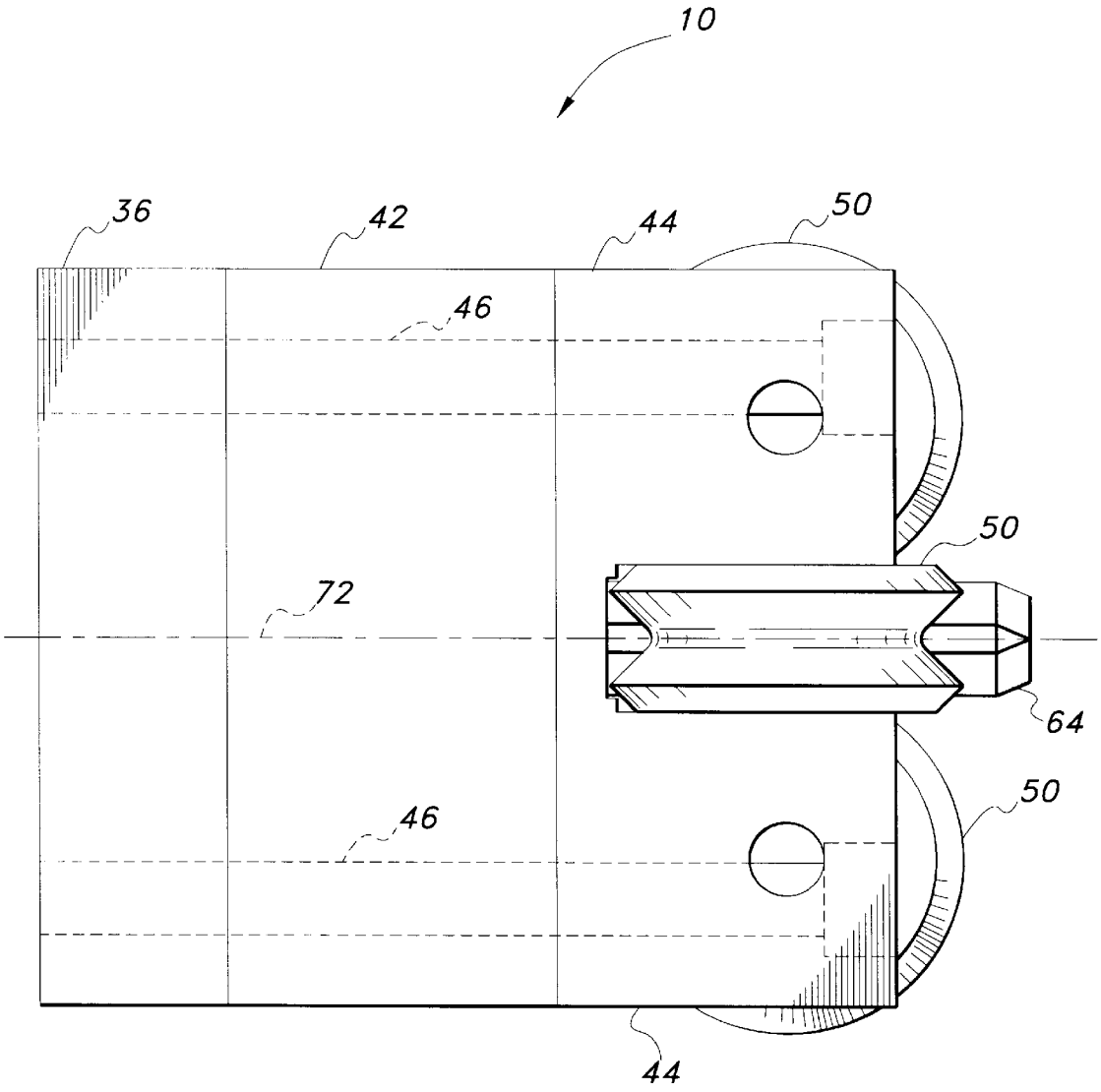
FIG. 4 is a side elevational view further illustrating the tool shown in FIGS. 1–3.

The tool 10 also includes four grooved rollers 50 which are rotatably mounted within one of the roller cavities 34. Each of the rollers 50 is rotatably mounted on a roll pin 52 secured within the head 30 and is rotatable about a longitudinally extending centerline axis (not shown) of the corresponding one of roll pins 52. Each of the roll pins 52 extends between an adjacent pair of the face blocks 44 and may be retained within head 30 by the positioning of bolts 46 within head 30. Alternatively, the roll pins 50 may be secured within head 30 by other means including set screws or a slight press fit within head 30. Two of the grooved rollers, designated as 50A and 50B in FIG. 2, are rotatable in a substantially vertical plane. The other two rollers, designated as 50C and 50D in FIG. 2, are rotatable in a substantially horizontal plane. Each of the grooved rollers 50 includes a periphery 54 which extends into the interior cavity 32, as best seen in FIG. 2, and is configured to engage a portion of the outer surface of a shaped tube, such as the square tube 12 shown in FIG. 5.

In the illustrative embodiment the periphery 54 of each of the grooved rollers 50 includes a generally V-shaped portion 56 which is effective for engaging one of the corner portions of a square tube to be reduced, such as corner portions 18 of tube 12. The periphery 54 of each roller 50 further includes a pair of beveled end surfaces 58 extending from opposite sides of the centrally disposed, V-shaped portion 56. As best seen in FIG. 2, each of the end surfaces 58 of each of the grooved rollers 50 is disposed in close proximity with one of the end surfaces 58 of an adjacent one of the grooved rollers 50. For instance, one of the end surfaces 58 of roller 50A is disposed in close proximity with one of the end surfaces 58 of roller 50C, while the other end surface 58 of roller 50A is disposed in close proximity with one of the end surfaces 58 of roller 50D. At the various interface locations, the end surfaces 58 of adjacent rollers 50 are substantially parallel to one another as shown in FIG. 2. The end surfaces 58 may be slightly spaced from one another, or may actually touch one another at the interface locations.

Due to the positioning of the rollers 50 relative to one another, the V-shaped portions 56 of the rollers 58 combine to create a substantially square shaped entrance 60 of the interior cavity 32 of the head 30. The size of entrance 60 is less than the outside dimensions of the square tube to be reduced, thus forcing the end of the tube to engage each of the rollers 50 thereby causing an end reduction, such as that shown with respect to end portion 20 of tube 12. The maximum longitudinal length of the reduced end portion 20 of tube 12, may be determined primarily by a longitudinal length 62 of the spacer blocks 42.

The tool 10 further includes a mandrel 64 disposed within the interior cavity 32 of the head 30. The mandrel 64 is preferably a solid metal rod having a polygonal cross-section, which may vary with the shape of the tube being reduced. In the illustrative embodiment, mandrel 64 has a generally square cross-section. As best seen in FIG. 2, the mandrel 64 is spaced apart from the periphery 54 of each of the rollers 50. The required spacing between mandrel 64 and the rollers 50 varies depending upon a variety of factors including the size and wall thickness of the tube being reduced, and the desired reduction in size of the end of the tube. Mandrel 64 prevents the reduced end portion of the tube being reduced, such as portion 20 of tube 12, from collapsing, or deforming inward due to the force exerted by rollers 50 on the tube. Mandrel 64 includes a first, forward end 66 which protrudes forward from the head 30 and an opposite end 68 which is secured to the head 30 by conventional means such as a bolt 70, or other suitable means. The mandrel 64 extends longitudinally through the face block portion 40, the spacer portion 38 and into the base block 36. Mandrel 64 includes a plurality of longitudinally extending chamfers 74, with one being formed in each of the corners of the polygonal cross-section, to facilitate engagement with the tube being reduced. More particularly, the chamfers 74 are required to minimize the drag effect due to contact between the mandrel 64 and the tube being end reduced as mandrel 64 is inserted into the hollow interior of the tube, such as the interior portion 14 of tube 12.

Figure 1:
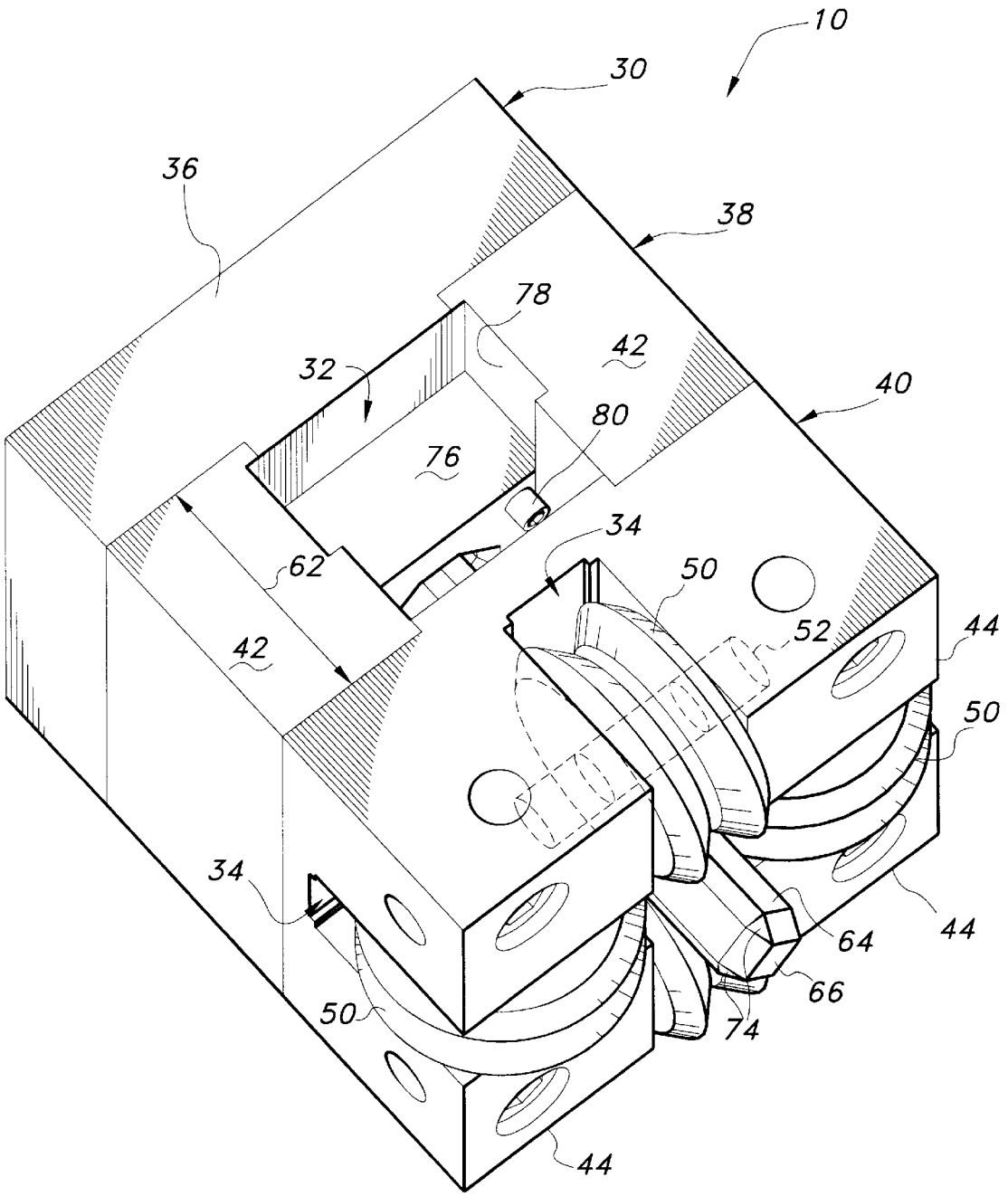
FIG. 1 is a perspective view illustrating a tool for working a shaped metal tube having a hollow interior and an outer surface to produce an end reduction in the tube, according to a first embodiment of the present invention.

The tool 10 may optionally include a means for maintaining a substantially uniform shape of the end of the tube being reduced. For instance, as shown with respect to tube 12, reduced end portion 20 has a substantially uniform square shape which is substantially the same as that of the remaining portion 22 of tube 12. In the illustrative embodiment, the means for maintaining a substantially uniform shape of the end of the tube being reduced, comprises a rake 76 which is disposed within the interior cavity 32 of the head 30. The rake 76 is made from a block of cold-rolled steel, tool steel, or other suitable material. As shown in FIG. 1, each of the spacer blocks 42 may include a vertically extending groove 78 which is sized to accept one side of the rake 76. Rake 76 is then fixedly attached to the base block 36 by conventional means, such as a pair of bolts 80.

Rake 76 includes an aperture 82 extending therethrough, with the aperture 82 communicating at a forward end thereof with the interior cavity 32 of the head 30. The aperture 82 includes a forward, flared portion 84 and a tapered bore 86 extending longitudinally rearwardly from the forward, flared portion 84. The tapered bore 86 has a shape which substantially matches that of the tube being reduced and gradually reduces in size from a forward to a rearward end of the bore 86. In the illustrative embodiment bore 86 has a generally square shape. The inventor has determined that in certain applications the end of the tube being reduced, such as end portion 20 of tube 12, may tend to flare outward locally after the end portion 20 has passed through the rollers 50. As the end portion 20 progresses through the head 30, the end portion 20 engages the rake 76. The forward, flared portion 84 is effective for receiving the end portion 20, even if it has flared outwardly somewhat, and serves as a guide which forces the end portion 20 into the tapered bore 86. The tapered bore 86 is effective for correcting any outward flaring of the end portion 20 which may have occurred, so as to maintain a substantially uniform square shape of the end portion 20. After the end portion 20 of tube 12 has reached the rear end of the tapered bore 86, tube 12 may be retracted and removed from tool 10, with the reduction of the end portion 20 being completed.

Figure 10:
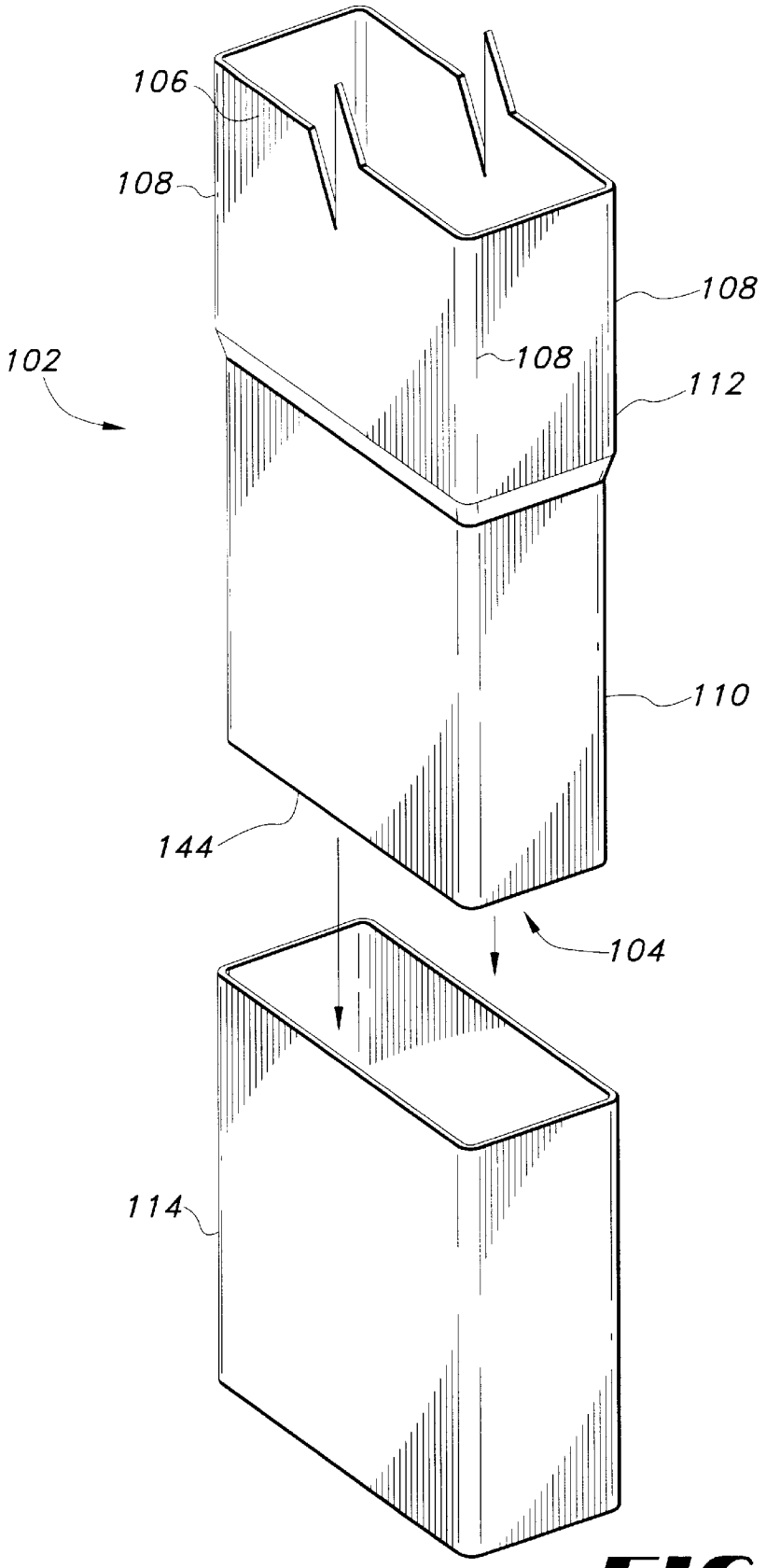
FIG. 10 is a perspective view of a rectangular tube having an end reduction achieved by the tool shown in FIGS. 6–9.

FIGS. 6–9 illustrate a tool 100 according to a second embodiment of the present invention, which is configured to achieve an end reduction in a hollow, shaped metal tube, such as the substantially rectangular metal tube 102 shown in FIG. 10. Tube 102 has a hollow interior 104 and an exterior surface 106, including six corner portions 108. Tool 100 is effective for reducing an end portion 110 of tube 102, which is reduced in size relative to a remaining portion 112, but retains the same, substantially rectangular shape as the remaining portion 112. The reduced end portion 110 of the rectangular tube 102 may be inserted into another rectangular tube 114 of the same size.

Tool 100 includes a head 116 having a longitudinally extending interior cavity 118 and a plurality of roller cavities 120 communicating with the interior cavity 118. Similar to tool 10, the head 116 of tool 100 includes a base block 122, a spacer portion 124 connected to base block 122, and a face block portion 126 connected to the spacer portion 124. In the illustrative embodiment, the face block portion 126, spacer portion 124 and base block 122 are fixedly attached to one another by conventional means such as bolts 128. Alternatively, the face block portion 126, spacer portion 124 and base block 122 may be made as a unitary construction from a material such as cold-rolled steel, tool steel or an equivalent material. The base block 122, spacer portion 124 and face block portion 126 combine to define the interior cavity 118 of the head 116. In the illustrative embodiment, the spacer portion 124 comprises a single spacer block, but alternatively may include a pair of laterally spaced blocks. The face block portion 126 includes the roller cavities 120 and a plurality of face blocks 130 configured and disposed relative to one another to define the roller cavities 120.

Tool 100 further includes a plurality of the grooved rollers 50, described previously with respect to tool 10, which are rotatably mounted in the face block portion 126 of the head 116. Similar to tool 10, each of the rollers 50 of tool 100 is rotatably mounted on a roll pin 52 which is secured within an adjacent pair of the face blocks 130. However, unlike tool 10, each of the grooved rollers 50 of tool 100 is rotatable about a plane which is inclined relative to vertical. The periphery 54 of each of the grooved rollers 50 of tool 100 extends into the interior cavity 118 and engages a corner portion of the rectangular tube being reduced, such as the corner portions 108 of tube 102 as tube 102 passes into the interior cavity 118 of head 116. Unlike tool 10, only one of the beveled end surfaces 58 of each roller 50 is disposed in close proximity to the beveled end surface 58 of an adjacent grooved roller 50. The remaining beveled end surface 58 is disposed in close proximity to one of a pair of flat-area rollers 132 which are included in the tool 100.

Figure 7:
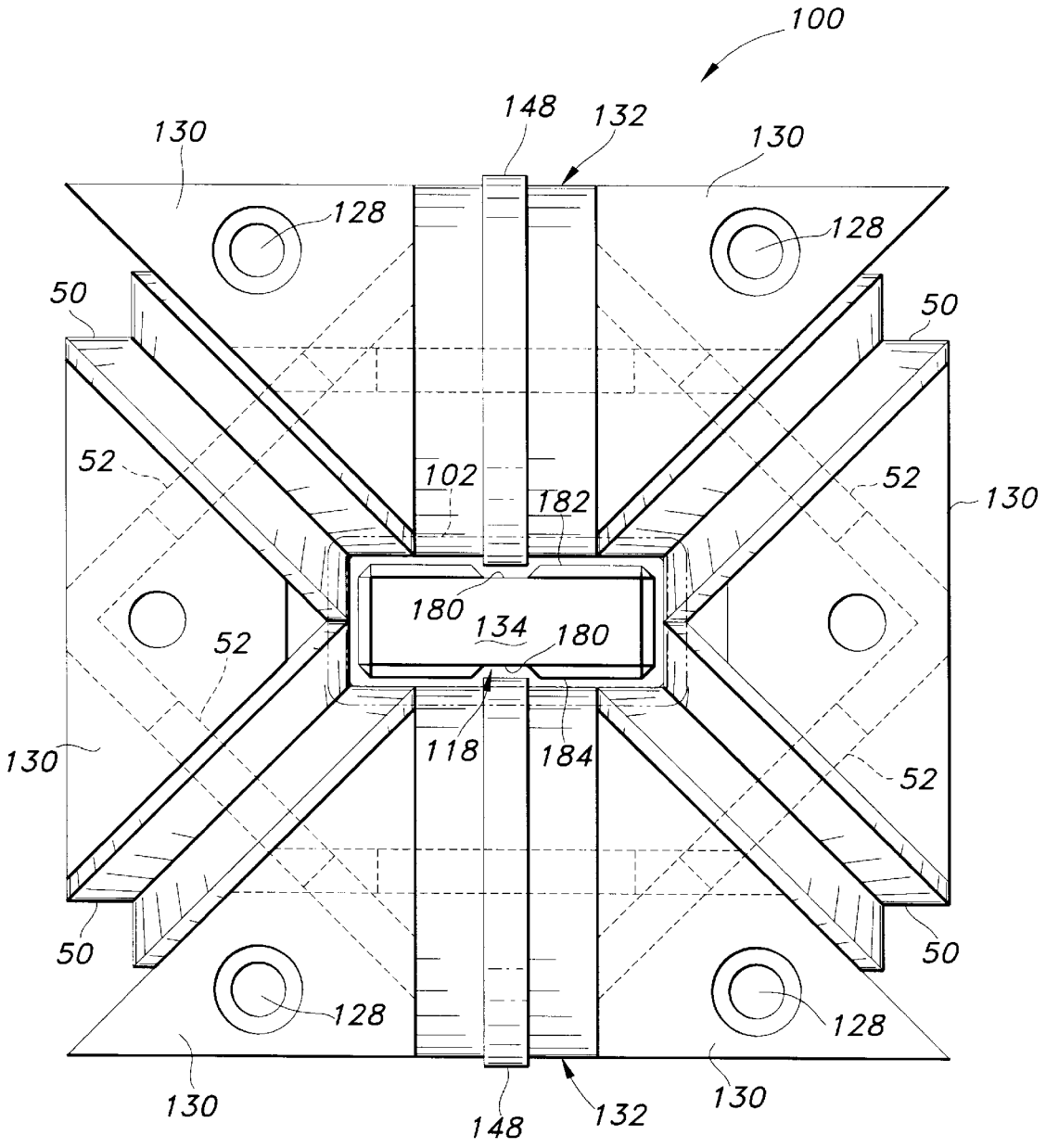
FIG. 7 is a front elevational view further illustrating the tool shown in FIG. 6.
Figure 8:
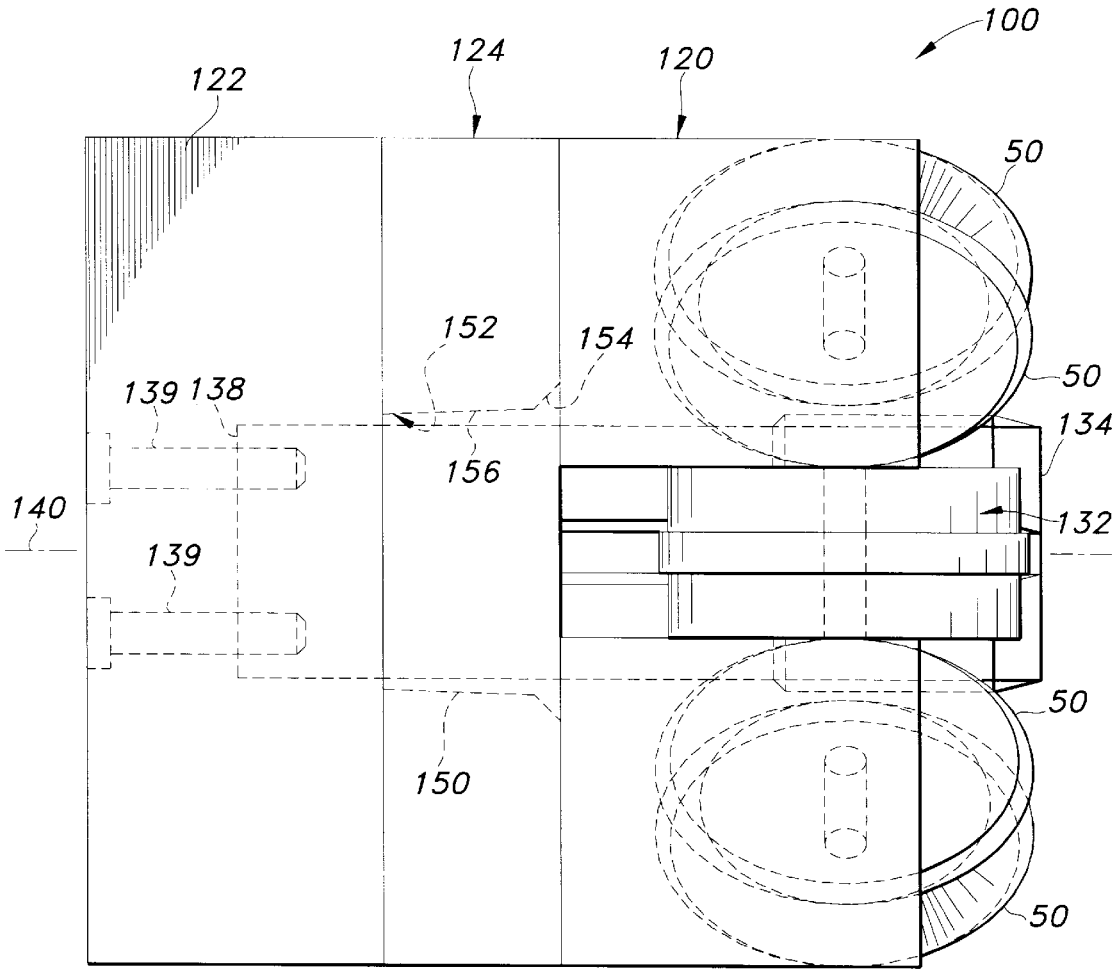
FIG. 8 is a plan view further illustrating the tool shown in FIGS. 6 and 7.
Figure 9:
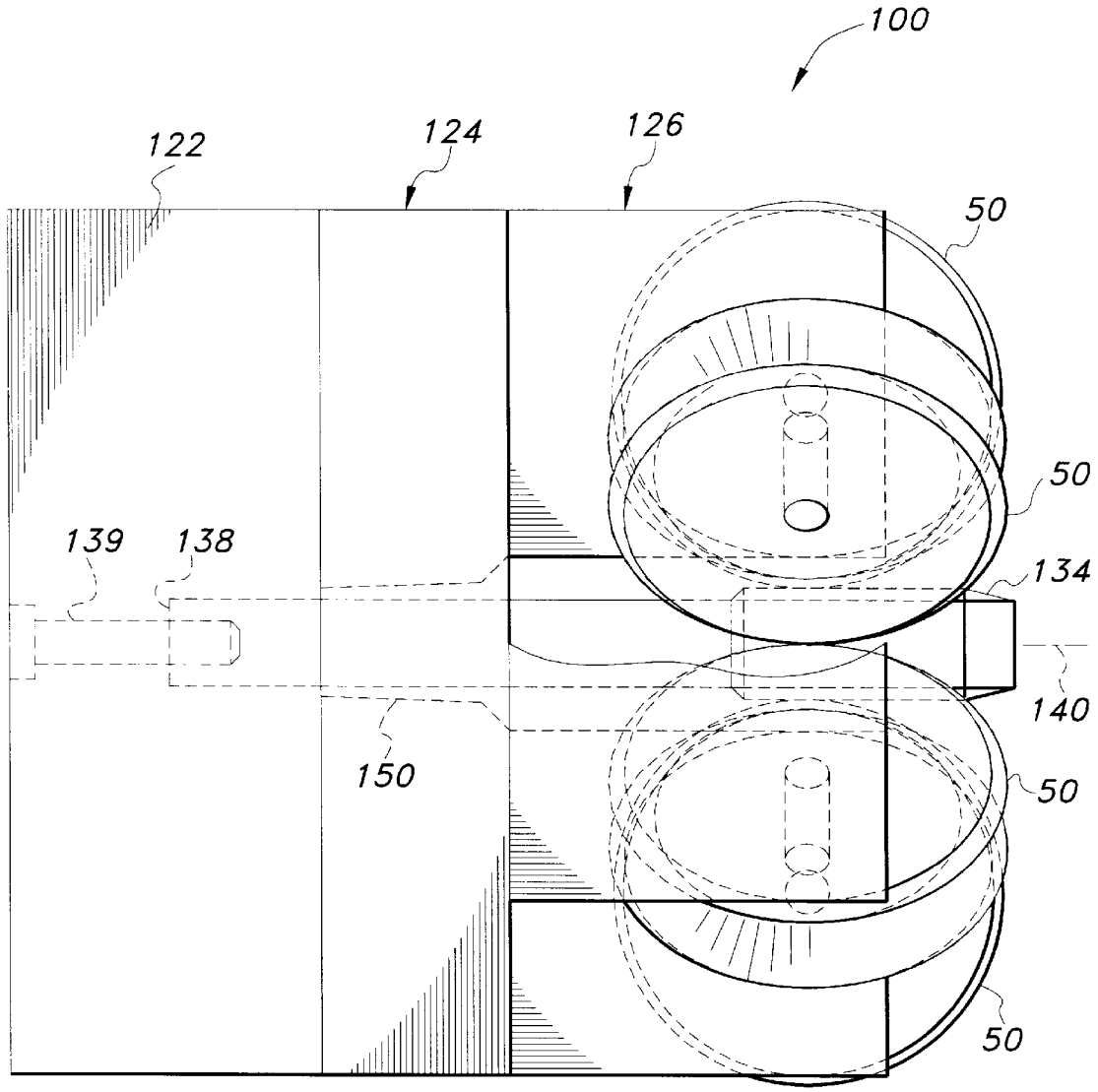
FIG. 9 is a side elevational view further illustrating the tool shown in FIGS. 6–8.

Tool 100 further includes a mandrel 134 having a forward end 136 protruding forward from the head 116 and an opposite end 138 which is secured to the base block 122 by conventional means such as a pair of bolts 139. The mandrel 134 extends along a longitudinally extending centerline axis 140 of tool 100, through the face block portion 126, spacer portion 124 and into the base block 122. Mandrel 134 preferably comprises a solid rod having a polygonal cross-section. More particularly, mandrel 134 preferably has a generally rectangular cross-section. As best seen in FIG. 7, the mandrel 134 is spaced apart from the grooved rollers 50 and the flat-area rollers 132. The required spacing between mandrel 134 and rollers 50 and rollers 132 varies with the factors discussed previously with respect to the mandrel 64. The forward end 136 of mandrel 134 includes a pair of longitudinally extending lead-in chamfers 135 formed in the two relatively short sides of mandrel 134, and a pair of longitudinally extending lead-in chamfers 137 formed in the two relatively long sides of mandrel 134. As with mandrel 64, the lead-in chamfers 135 and 137 of mandrel 134 are required to minimize the drag effect due to contact between the mandrel 134 and the tube being end reduced such as tube 102. Mandrel 134 further includes a pair of longitudinally extending grooves 180. One of the grooves 180 is formed in an upper surface 182 of mandrel 134 and the other groove 180 is formed in a lower surface 184 of mandrel 134. The grooves 180 are aligned with, and have a shape which is complimentary to a portion of one of the flat-area rollers 132 as subsequently discussed.

Figure 6:
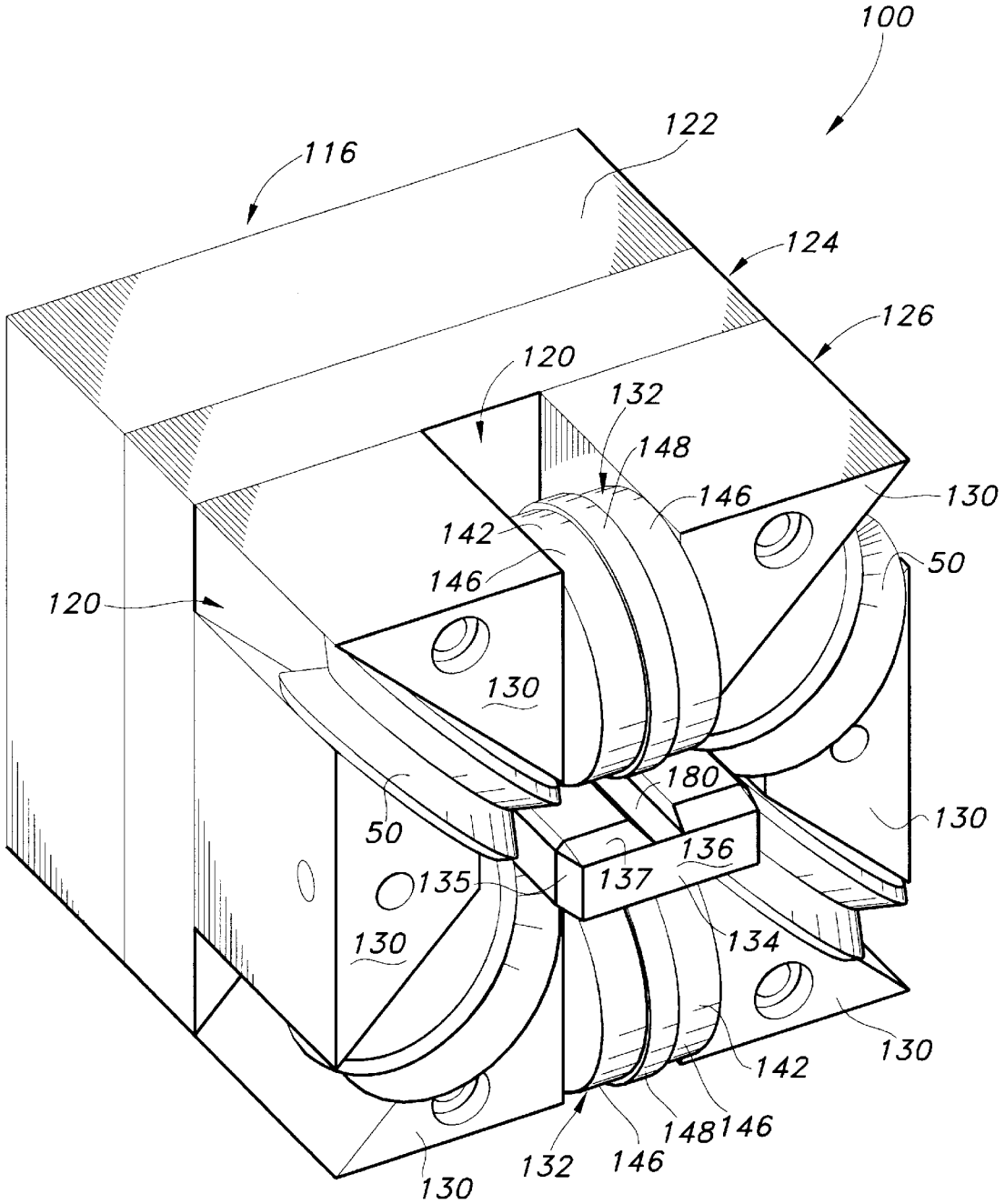
FIG. 6 is a perspective view illustrating a tool for working a shaped metal tube having a hollow interior and an outer surface to produce an end reduction in the tube, according to a second embodiment of the present invention.

As shown in FIGS. 6 and 7, one of the flat-area rollers 132 is disposed above the mandrel 134, while the other flat-area roller 132 is disposed below the mandrel 134. Each of the flat-area rollers 132 has a periphery 142 which is effective for engaging at least a portion of one of the relatively long sides 144 of the substantially rectangular tube 102 as the tube 102 passes into the interior cavity 118 of tool 100. Both of the flat-area rollers 132 are rotatably mounted on one of the roll pins 52 which are secured within each one of an adjacent pair of the face blocks 130. Each of the flat-area rollers 132 is rotatable in a substantially vertical plane. In the illustrative embodiment, the periphery 142 of each of the flat-area rollers includes a pair of substantially cylindrical end portions 146 and a raised, substantially cylindrical central portion 148 extending laterally between the end portions 146. The diameter of the raised central portion 148 is larger than that of either of the end portions 146, which are preferably equal to one another, such that the raised central portion 148 protrudes or extends radially beyond the end portions 146. Each of the raised central portions 148 engages a portion of one of the long sides 144 of the rectangular tube 102 as tube 102 enters the interior cavity 118 of the head 116. Each of the raised central portions 148 has a shape which is complimentary to the shape of the adjacent one of the grooves 180 of mandrel 134. The raised central portions 148 of the flat-area rollers 132 cooperate with the grooves 180 in mandrel 134 to further work the tube being end-reduced, i.e, in additional to the work performed by the rollers 50. The combination of the raised central portions 148 of the flat-area rollers 132 and the grooves 180 of mandrel 134 create a local, substantially uniform depression in the upper and lower surfaces of the tube being end reduced. These local depressions do not adversely affect the tube being end reduced. Alternatively, the raised central portion 148 may be omitted from each of the flat-area rollers 132, so that the periphery 142 of each roller 132 has a substantially cylindrical shape with uniform diameter throughout. In this instance, the periphery 142 of each roller 132 may engage substantially all of one of the long sides 144 of tube 102 as tube 102 passes into the interior cavity 118. The incorporation or exclusion of the raised central portion 148 in each of the flat-area rollers 132 and the incorporation of grooves 180 in mandrel 134 depends upon the size, wall thickness and the desired end reduction, of the rectangular tube being end-reduced. The incorporation of the raised central portions 148 in the flat-area rollers 132 and grooves 180 in mandrel 134 is particularly useful when the long sides of the rectangular tube being end-reduced are significantly greater in length than the short sides of the rectangular tube.

Similar to tool 10, tool 100 may optionally include a means for maintaining a substantially uniform shape of the end of the tube being reduced. For instance, as shown with respect to tube 102, the reduced end portion 110 has a substantially uniform rectangular shape which is substantially the same as that of the remaining portion 112 of the tube 102. In the illustrative embodiment, the means for maintaining a substantially uniform shape of the end of the tube being reduced, comprises a rake 150 which is disposed within the interior cavity 118 of the head 116. In the illustrative embodiment, cavity 118 does not extend through the upper surface of head 116, and accordingly, rake 150 is inserted into the spacer portion 124 of head 116, prior to attaching the spacer portion 124 and the base block 122 to one another. The rake 150 may then be fixedly attached to the base block 122 by conventional means such as one or more bolts (not shown). In the instance when the various components of head 116 are made as a unitary construction, the interior cavity 118 may extend through either the upper or lower surface of head 116 to permit installation of rake 150.

The rake 150 is made from a block of cold-rolled steel, tool steel or other suitable material. The function of the rake 150 is substantially the same as that of rake 76 of tool 10. Rake 150 includes an aperture 152 extending therethrough, with the aperture 152 communicating at a forward end thereof with the interior cavity 118 of the head 116. The aperture 152 includes a forward, flared portion 154 and a tapered bore 156 extending longitudinally rearwardly from the forward, flared portion 154. The tapered bore 156 has a generally rectangular shape which gradually reduces in size from a forward to a rearward end of the bore 156. As the reduced end of a shaped tube, such as end portion 110 of tube 102, passes through the head 118 the end portion 110 engages the rake 150. The forward, flared portion 154 is effective for receiving the end portion 110, even if it is flared outwardly somewhat, and serves as a guide which forces the end portion 110 into the tapered bore 156. The tapered bore 156 is effective for correcting any outward flaring of the end portion 110 which may have occurred, so as to maintain a substantially uniform rectangular shape of the end portion 110. After the end portion 110 of tube 102 has reached the rear end of the tapered bore 156, tube 102 may be retracted and removed from tool 100, with the reduction of the end portion 110 being completed.

Figure 11:
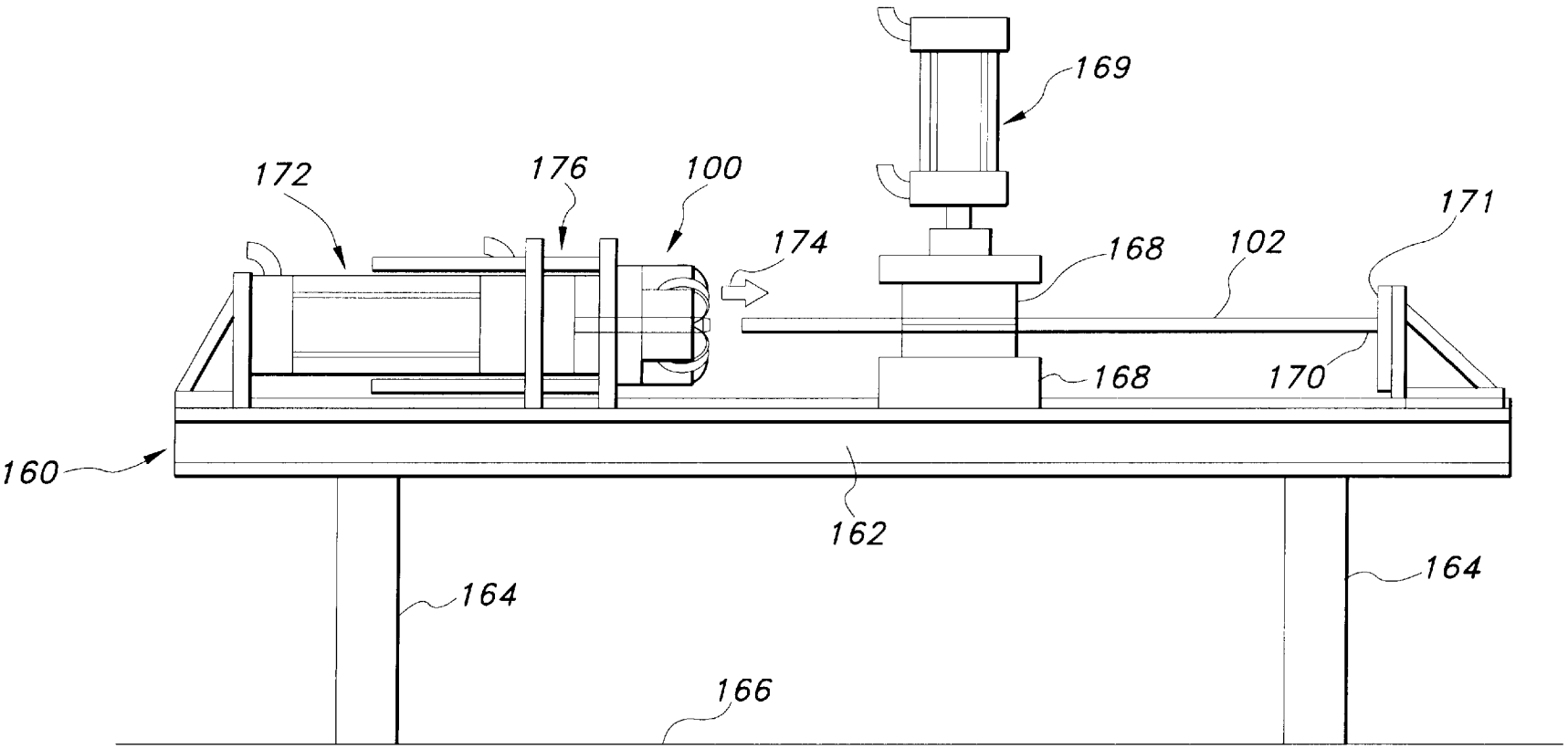
FIG. 11 is a schematic view of a system for achieving an end reduction in a shaped metal tube, with the system incorporating one of the embodiments of the tool of the present invention.

In operation, either tool 10 or tool 100 may be used to reduce the end of a shaped, hollow metal tube as discussed previously. The manner in which either of the tools 10 or 100 engage the corresponding shaped, hollow tube, so as to effect an end reduction in the tube, may be better understood with reference to FIG. 11. For purposes of discussion tool 100 is shown in FIG. 11, although the subsequently described system and method may also be used in conjunction with tool 10.

Tool 100 is slidingly mounted to a support structure 160 having a base 162 and a plurality of legs 164 attached at one end to the base 162 and having the opposite end resting on a floor 166, or other suitable surface, of a work area. Also for purposes of discussion, FIG. 11 illustrates the substantially square tube 102 prior to the reduction of the end portion 110 as shown in FIG. 10. A portion of tube 102 is secured in a pair of clamping blocks 168, with a lower one of the clamping blocks 168 being fixedly attached to the base 162 of support structure 160. The clamping blocks 168 encapsulate a portion of the tube 102, holding it in place during the swaging or end reduction process. A clamping force may be applied to the upper one of the blocks 168 by a hydraulic actuator 169. Alternatively, a clamping force may be applied to blocks 168, and the portion of tube 102 encapsulated by blocks 168, by other conventional means. Tube 102 is oriented within the clamping blocks 168 to properly engage the grooved rollers 50 of the tool 100. An end 170 of the tube 102 is disposed in an abutting relationship with a stop block 171 which is fixedly attached, by conventional means, to the base 162 of the support structure 160.

The tool 100 is connected to an actuating means, indicated generally at 172, which is effective for translating the tool 10 in a direction 174 so that the tool 100 engages the tube 102. In the illustrative embodiment, the actuating means 172 comprises a hydraulically actuated cylinder which is connected to tool 100. The hydraulic cylinder may be directly attached to tool 100 or alternatively may be attached to a plate which in turn is attached to tool 100. The hydraulic cylinder may be powered by a hydraulic motor (not shown) and associated conduits (not shown) for delivering the hydraulic fluid to and from the actuating means 172. Alternatively, the actuating means 172 may comprise a variety of other conventional actuation means, such as one or more pneumatic cylinders, a servo motor, worm gear, etc. which are connected to the tool 100 and are effective for translating the tool 100 in direction 174. The actuating means may further include a guide means 176 attached to tool 100 for maintaining the proper orientation of the tool 100 as it is actuated. The actuating means 172 may further include a control means, (not shown) for controlling the distance which tool 100 translates, and accordingly, the length of the end reduction of tool 102 which is achieved.

While the foregoing description has set forth the preferred embodiments of the present invention in particular detail, it must be understood that numerous modifications, substitutions and changes can be undertaken without departing from the true spirit and scope of the present invention as defined by the ensuing claims. For instance, although tool 10 has been illustrated with the included rollers 50 configured and positioned relative to one another so as to achieve an end reduction in a substantially square tube, the rollers 50 may be repositioned relative to one another within tool 10 so as to achieve an end reduction in a substantially rectangular tube. Furthermore, the periphery 54 of the rollers 50 of tool 10 may be modified so that the plurality of rollers 50 of tool 10 substantially encapsulate an oval-shaped tube so as to achieve an end reduction in the oval-shaped tube. Furthermore, tool 10 may include a plurality of rollers which are positioned relative to one another and include peripheries which are configured so that the plurality of rollers encapsulates a D-shaped tube so as to achieve an end reduction in the D-shaped tube. Also, although tool 100 has been illustrated with the included rollers 50 and rollers 132 configured and positioned relative to one another to achieve an end reduction in a substantially rectangular tube, one or more of the rollers 50 and 132 may be repositioned and/or reconfigured so that the combination of rollers 50 and 132 substantially encapsulate an oval or a D-shaped tube so as to achieve an end reduction in the oval or D-shaped tube, respectively. It is also envisioned that an end reduction in tubes having other shapes may be achieved by a tool embodying the principle of the present invention. The invention is therefore not limited to specific preferred embodiments as described, but is only limited as defined by the following claims.

What is claimed is:

1. A tool for working a substantially square metal tube having a hollow interior and an outer surface including four corner portions to produce an end reduction in the tube, said tool comprising:

a head having a longitudinally extending interior cavity and a plurality of roller cavities, each of said roller cavities communicating with said interior cavity;

four grooved rollers, each of said grooved rollers being rotatably mounted within one of said roller cavities, each of said grooved rollers having a periphery extending into said interior cavity, said periphery of each of said grooved rollers having a generally V-shaped portion, said V-shaped portions of said grooved rollers combining to define a substantially square shaped entrance of said interior cavity each of said V-shaped portions being effective for engaging one of the corner portions of the outer surface of the tube as the tube passes into said interior cavity of said head;

a mandrel disposed within said interior cavity of said head, said mandrel having a first end protruding forward from said head, said mandrel being immovable relative to said head and spaced apart from said periphery of each of said grooved rollers, said mandrel being inserted into the hollow interior of the tube as the tube passes into said interior cavity.

2. The tool as recited in claim 1, wherein:

said head includes a base block, a spacer portion connected to said base block, and a face block portion connected to said spacer portion;

said base block, said spacer portion and said face block portion combine to define said interior cavity;

said mandrel extends longitudinally through said face block portion and said spacer portion and into said base block;

said face block portion includes said roller cavities and a plurality of face blocks configured to define said roller cavities.

3. The tool as recited in claim 1, wherein:

each of said grooved rollers is rotatably mounted on a roll pin disposed within said head;

two of said grooved rollers are rotatable in a substantially vertical plane and two of said grooved rollers are rotatable in a substantially horizontal plane.

4. The tool as recited in claim 1, wherein:

said generally V-shaped portion of said periphery comprises a centrally disposed portion of said periphery of each of said grooved rollers;

said periphery of each of said grooved rollers further includes a pair of end surfaces, each of said end surfaces extending from opposite sides of said centrally disposed V-shaped portions;

each of said end surfaces of each of said grooved rollers are disposed in close proximity to one of said end surfaces of an adjacent one of said grooved rollers, whereby said plurality of grooved rollers substantially encapsulate the substantially square metal tube as the tube engages said rollers.

5. The tool as recited in claim 1, wherein:

said mandrel is a substantially solid rod having a generally polygonal cross-section;

said mandrel includes a forward end having at least one longitudinally extending chamfer to facilitate insertion into the hollow interior of the tube.

6. The tool as recited in claim 1, wherein:

said grooved rollers which are disposed relative to one another so as to substantially encapsulate the tube as the tube passes into said interior cavity.

7. A tool as recited in claim 1, wherein:

said mandrel further includes an opposite end which is secured to said head.

8. The tool as recited in claim 2, wherein:

said base block, said spacer portion and said face block portion are fixedly attached to one another.

9. The tool as recited in claim 2, wherein:

said base block, said spacer portion and said face block portion comprise a one-piece construction.

10. The tool as recited in claim 3, wherein:

each of said roll pins extends between an adjacent pair of said face blocks.

11. The tool as recited in claim 4, wherein:

each of said end surfaces of said grooved rollers comprises a beveled surface.

12. The tool as recited in claim 5, wherein:

said mandrel has a generally square cross-section.

13. The tool as recited in claim 5, wherein:

said mandrel has a generally rectangular cross-section.

14. The tool as recited in claim 6, wherein:

each of said grooved rollers is made of tool steel.

15. A tool for working a shaped metal tube having a hollow interior and an outer surface including four corner portions to produce an end reduction in the tube, wherein the shaped metal tube is a substantially rectangular metal tube having a pair of opposing, relatively long sides and a pair of opposing, relatively short sides, said tool comprising:

a head having a longitudinally extending interior cavity and a plurality of roller cavities, each of said roller cavities communicating with said interior cavity;

a plurality of grooved rollers, each of said grooved rollers being rotatably mounted within one of said roller cavities, each of said grooved rollers having a periphery extending into said interior cavity and configured to engage a portion of the outer surface of the tube as the tube passes into said interior cavity of said head;

a mandrel disposed within said interior cavity of said head, said mandrel having a first end protruding forward from said head, said mandrel being immovable relative to said head and spaced apart from said periphery of each of said grooved rollers, said mandrel being inserted into the hollow interior of the tube as the tube passes into said interior cavity; wherein said head includes a base block, a spacer portion connected to said base block, and a face block connected to said spacer portion;

said base block, said spacer and said face block portion combine to define said interior cavity;

said mandrel extends longitudinally through said face block portion and said spacer portion and into said base block;

said face block portion includes said roller cavities and a plurality of face blocks configured to define said roller cavities;

said tool includes four of said grooved rollers;

said periphery of each of said grooved rollers has a generally V-shaped portion effective for engaging one of the corner portions of the tube as the tube passes into said interior cavity of said tool;

said tool further includes a pair of flat-area rollers, each of said flat-area rollers being disposed laterally between a pair of said grooved rollers, each of said flat-area rollers being effective for engaging one of the relatively long sides of the substantially rectangular metal tube as the tube passes into said interior cavity of said head.

16. The tool as recited in claim 15, wherein:

said tool further includes a plurality of roll pins disposed within said head;

each of said grooved rollers and each of said flat-area rollers is rotatably mounted on one of said roll pins;

each of said flat-area rollers is rotatable in a substantially vertical plane and each of said grooved rollers is rotatable in a plane which is inclined relative to a vertical plane.

17. The tool as recited in claim 16, wherein:

a first one of said flat-area rollers is disposed above said mandrel and the other of said flat-area rollers is disposed below said mandrel;

said periphery of each of said flat-area rollers includes a pair of substantially cylindrical end portions and a raised, substantially cylindrical central portion extending between said end portions, said raised portion extending radially beyond said end portion and being effective for engaging one of the relatively long sides of the substantially rectangular metal tube as the tube passes into said interior cavity of said head.

18. The tool as recited in claim 17, wherein:

said mandrel includes a pair of longitudinally extending grooves, each of said grooves being formed in one of an upper surface and a lower surface of said mandrel;

each of said grooves has a shape which is complimentary to a shape of said raised, substantially cylindrical central portion of one of said flat-area rollers.

19. A tool for working a shaped metal tube having a hollow interior and an outer surface to produce an end reduction in the tube, said tool comprising:

a head having a longitudinally extending interior cavity and a plurality of roller cavities, each of said roller cavities communicating with said interior cavity;

a plurality of grooved rollers, each of said grooved rollers being rotatable mounted within one of said roller cavities, each of said grooved rollers having a periphery extending into said interior cavity and configured to engage a portion of the outer surface of the tube as the tube passes into said interior cavity of said head;

a mandrel disposed within said interior cavity of said head, said mandrel having a first end protruding forward from said head, said mandrel being immovable relative to said head and spaced apart from said periphery of each of said grooved rollers, said mandrel being inserted into the hollow interior of the tube as the tube passes into said interior cavity:

said tool further comprises a rake disposed within said interior cavity of said head;

said rake includes an aperture extending therethrough, said aperture communicating with said interior cavity;

said aperture includes a forward, flared portion and a tapered bore extending longitudinally rearward from said forward, flared portion.

20. The tool as recited in claim 19, wherein:

said mandrel extends longitudinally through said aperture of said rake and into said base block.

21. A tool for working a shaped metal tube having a hollow interior and an outer surface to produce an end reduction in the tube, said tool comprising:

a head having a longitudinally extending interior cavity and a plurality of roller cavities, each of said roller cavities communicating with said interior cavity;

a plurality of grooved rollers, each of said grooved rollers being rotatable mounted within one of said roller cavities, each of said grooved rollers having a periphery extending into said interior cavity and configured to engage a portion of the outer surface of the tube as the tube passes into said interior cavity of said head;

a mandrel disposed within said interior cavity of said head, said mandrel having a first end protruding forward from said head, said mandrel being immovable relative to said head and spaced apart from said periphery of each of said grooved rollers, said mandrel being inserted into the hollow interior of the tube as the tube passes into said interior cavity; wherein;

said tool includes four of said grooved rollers and further include a pair of flat-area rollers;

said grooved rollers and said flat-area rollers are disposed relative to one another so as to substantially encapsulate the tube as the tube passes into said interior cavity.

22. The tool as recited in claim 21, wherein:

each of said grooved rollers and each of said flat-area rollers is made of tool steel.

23. A tool as recited in claim 21, wherein:

said periphery of each of said grooved rollers has a generally V-shaped portion effective for engaging one of the corner portions of the tube as the tube passes into said interior cavity of said tool;

each of said flat-area rollers is disposed laterally between a pair of said grooved rollers and is effective for engaging one of the relatively long sides of the substantially rectangular metal tube as the tube passes into said interior cavity of said head.

24. A tool as recited in claim 21, further comprising:

a rake disposed within said interior cavity of said head; wherein said rake includes an aperture extending therethrough, said aperture communicating with said interior cavity;

said aperture includes a forward, flared portion and a tapered bore extending longitudinally rearward from said forward, flared portion.

25. A tool as recited in claim 21, wherein:

said mandrel further includes an opposite end which is secured to said head.

* * * * *